US011373569B2

(12) United States Patent
Zheng

(10) Patent No.: US 11,373,569 B2
(45) Date of Patent: Jun. 28, 2022

(54) DISPLAY DRIVING CIRCUIT

(71) Applicant: Shenzhen China Star Optoelectronics Semiconductor Display Technology Co., Ltd., Shenzhen (CN)

(72) Inventor: Xuhuang Zheng, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 203 days.

(21) Appl. No.: 16/620,930

(22) PCT Filed: Nov. 8, 2019

(86) PCT No.: PCT/CN2019/116689
§ 371 (c)(1),
(2) Date: Dec. 10, 2019

(87) PCT Pub. No.: WO2021/042512
PCT Pub. Date: Mar. 11, 2021

(65) Prior Publication Data

US 2021/0335181 A1 Oct. 28, 2021

(30) Foreign Application Priority Data

Sep. 5, 2019 (CN) ..... 201910836264.3

(51) Int. Cl.
*G09G 3/20* (2006.01)

(52) U.S. Cl.
CPC ..... *G09G 3/20* (2013.01); *G09G 2300/08* (2013.01); *G09G 2310/0267* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 2007/0263763 | A1* | 11/2007 | Moon | G11C 19/00 377/68 |
| 2019/0066596 | A1* | 2/2019 | Xue | G11C 19/28 |
| 2019/0066597 | A1* | 2/2019 | Lan | G09G 3/3266 |
| 2019/0156778 | A1 | 5/2019 | Li et al. | |
| 2019/0279588 | A1 | 9/2019 | Kim et al. | |

FOREIGN PATENT DOCUMENTS

| | | |
|---|---|---|
| CN | 1677575 | 10/2005 |
| CN | 101147203 | 3/2008 |
| CN | 101944344 | 1/2011 |
| CN | 102270434 | 12/2011 |
| CN | 102708778 | 10/2012 |

(Continued)

*Primary Examiner* — Ifedayo B Iluyomade

(57) ABSTRACT

Provided is a display driving circuit, which includes a pull-up control unit and a pull-up unit electrically connected to the pull-up control unit via a first node. The pull-up unit includes a capacitor and a first transistor. A first end of the capacitor is electrically connected to a clock signal input end and a second end of the capacitor is electrically connected to the first node. The gate of the first transistor is electrically connected to the first node, the source of the first transistor is electrically connected to the clock signal input end, the drain of the first transistor is electrically connected to a signal output end.

12 Claims, 3 Drawing Sheets

(56) References Cited

FOREIGN PATENT DOCUMENTS

| | | |
|---|---|---|
| CN | 103280200 | 9/2013 |
| CN | 105185347 | 12/2015 |
| CN | 205122156 | 3/2016 |
| CN | 105654905 | 6/2016 |
| CN | 106057161 | 10/2016 |
| CN | 106847221 | 6/2017 |
| CN | 107978276 | 5/2018 |
| CN | 108962154 | 12/2018 |
| CN | 109935196 | 6/2019 |
| CN | 110189676 | 8/2019 |
| JP | 11-109922 | 4/1999 |
| JP | 2005-309284 | 11/2005 |

* cited by examiner

DISPLAY DRIVING CIRCUIT

RELATED APPLICATIONS

This application is a National Phase of PCT Patent Application No. PCT/CN2019/116689 having International filing date of Nov. 8, 2019, which claims the benefit of priority of Chinese Patent Application No. 201910836264.3 filed on Sep. 5, 2019. The contents of the above applications are all incorporated by reference as if fully set forth herein in their entirety.

FIELD AND BACKGROUND OF THE INVENTION

The present invention relates to display technologies, and more particularly to a display driving circuit.

GOA (Gate Driver on Array) technology is to directly manufacture a scan driving circuit on an array substrate, thereby saving the space of the scan driving circuit individually deployed in an integrated chip. This facilitates narrow bezel in designing the display. Also, a soldering process of the integrated chip is reduced. Accordingly, the GOA technology is widely applied in the field of display panels.

A display driving circuit based on the GOA technology needs to provide a scan signal for the entire row of display units of a display panel. However, the scan signal provided by the display driving circuit will cause a signal loss during the transmission. Accordingly, in order to reduce the effect of the signal loss on a display function of the display panel, it needs to increase the strength of the scan signal provided by the display driving circuit, as much as possible.

FIG. 1 is a structural schematic diagram showing a display driving circuit used in existing arts. The display driving circuit includes a first clock signal input end CLK1, a second clock signal input end CLK2, a high-voltage signal input VGH, a low-voltage signal input end VGL, a cascaded signal input end OUT (n−1) and a signal output end OUT (n), and further includes a first transistor T1' electrically connected to the first clock signal input end CLK1, the cascaded signal input end OUT (n−1) and a first node Q, a second transistor T2' electrically connected to the high-voltage signal input VGH and a second node QB, a third transistor T3' electrically connected to the second clock signal input end, the first node Q and the signal output end OUT (n), a fourth transistor T4' electrically connected to the second node QB, the low-voltage signal input end VGL and the signal output end OUT (n), a fifth transistor T5' electrically connected to the first node Q, the low-voltage signal input end VGL and the second node QB, and a sixth transistor T6' electrically connected to the second node QB, the low-voltage signal input end VGL and the first node Q. A capacitor C' is connected between the first node Q and the signal output end OUT (n). The capacitor C' is configured to maintain and further increase the potential of the first node Q, so as to ensure a voltage signal inputted from the second clock signal input end CLK2 is transmitted to the signal output end OUT (n) via the third transistor T3'. Since the signal output end OUT (n) is electrically connected to the capacitor C' directly, a voltage signal inputted from the second clock signal input end CLK2 will charge the capacitor C' before being transmitted to the signal output end OUT (n), thereby consuming the strength of the signal transmitted to the signal output end OUT (n). For the display units located away from the display driving circuit, abnormal displaying may occur since the signals cannot be received with sufficient strength.

In the display driving circuit of existing arts, a storage capacitor electrically connected to a cascaded signal output end will consume the strength of a signal flowing to the cascaded signal output end, causing a displayed screen to be abnormal since a display unit cannot get sufficiently strong driving signals.

Based on above technical problems, solutions of the present application are provided below.

The present invention provides a display driving circuit, including a plurality of stages each which is directed to a driving unit that includes:

a pull-up control unit, electrically connected to a first clock signal input end, a first cascaded signal input end and a first node, configured to transmit a signal inputted from the first cascaded signal input end to the first node under the control of a signal inputted from the first clock signal input end;

a pull-up unit, electrically connected to the first node, a second clock signal input end and a second node, configured to transmit a signal inputted from the second clock signal input end to the second node under the control of a signal of the first node; and the second node, electrically connected to a cascaded signal output end, wherein the pull-up unit includes a capacitor and a first transistor, a first end of the capacitor is electrically connected to the second clock signal input end, a second end of the capacitor is electrically connected to the first node, and wherein a gate of the first transistor is electrically connected to the first node, a source of the first transistor is electrically connected to the second clock signal input end, a drain of the first transistor is electrically connected to the second node.

In the display driving circuit of the present application, the pull-up control unit includes a second transistor, the gate of the second transistor is electrically connected to the first clock signal input end, the source of the second transistor is electrically connected to the cascaded signal input end, the drain of the second transistor is electrically connected to the first node.

In the display driving circuit of the present application, the first transistor and the second transistor are n-type transistors or p-type transistors.

In the display driving circuit of the present application, the driving unit includes a first low-voltage signal input end and a second low-voltage signal input end, a voltage inputted to the first low-voltage signal input end is less than a voltage inputted to the second low-voltage signal input end.

In the display driving circuit of the present application, the driving unit further includes a pull-down unit, which is electrically connected to the second node, a third node, and the second low-voltage signal input end, and is configured to transmit a signal inputted from the second low-voltage signal input end to the second node under the control of a signal of the third node.

In the display driving circuit of the present application, the pull-down unit includes a third transistor, the gate of the third transistor is electrically connected to the third node, the source of the third transistor is electrically connected to the second low-voltage signal input end, the drain of the third transistor is electrically connected to the second node.

In the display driving circuit of the present application, the third transistor is an n-type transistor or a p-type transistor.

In the display driving circuit of the present application, the driving unit further includes a pull-down control unit, which is electrically connected to the first node, a second cascaded signal input end and the first low-voltage signal input end, and is configured to transmit a signal inputted from the first low-voltage signal input end to the first node under the control of a signal inputted from the second cascaded signal input end.

In the display driving circuit of the present application, the pull-down control unit includes a fourth transistor, the gate of the fourth transistor is electrically connected to the second cascaded signal input end, the source of the fourth transistor is electrically connected to the first low-voltage signal input end, the drain of the fourth transistor is electrically connected to the first node.

In the display driving circuit of the present application, the fourth transistor is an n-type transistor or a p-type transistor.

In the display driving circuit of the present application, the driving unit further includes a pull-down remaining unit, which is electrically connected to the first node, the third node, a high-voltage signal input and the first low-voltage signal input end, and is configured to transmit a signal inputted from the first low-voltage signal input end or a signal inputted from the high-voltage signal input to the third node under the control of a signal of the first node.

In the display driving circuit of the present application, the pull-down remaining unit includes a fifth transistor, a sixth transistor and a seventh transistor, the sources of the fifth transistor and the sixth transistor are electrically connected to the first low-voltage signal input end, the drain of the fifth transistor and the gate of the sixth transistor are electrically connected to the first node, the gate of the fifth transistor and the drain of the sixth transistor are electrically connected to the third node, the gate and the source of the seventh transistor are electrically connected to the high-voltage signal input, the drain of the seventh transistor is electrically connected to the third node.

In the display driving circuit of the present application, the fifth transistor, the sixth transistor and the seventh transistor are n-type transistors or p-type transistors.

In the display driving circuit of the present application, the first cascaded signal input end of the nth-stage driving unit is electrically connected to the cascaded signal output end of the (n−1)th-stage driving unit, and wherein the second cascaded signal input end of the nth-stage driving unit is electrically connected to the cascaded signal output end of the (n+1)th-stage driving unit, where n is an integer greater than or equal to 2.

In the display driving circuit of the present application, the first cascaded signal input end of the 1st-stage driving unit is electrically connected to a start signal line.

In the display driving circuit of the present application, the first clock signal input end is electrically connected to a first clock signal line, the second clock signal input end is electrically connected to a second clock signal line, the first low-voltage signal input end is electrically connected to a first low-voltage signal line, the second low-voltage signal input end is electrically connected to a second low-voltage signal line, the high-voltage signal input is electrically connected to a high-voltage signal line.

In the display driving circuit of the present application, a clock signal transmitted on the first clock signal line is opposite to a clock signal transmitted on the second clock signal line.

By arranging a capacitor and a cascaded signal output end on two branches that are connected in parallel to each other, the display driving circuit provided in the present invention can eliminate a loss of a signal outputted from the cascaded signal output end, caused by the capacitor, and improve strength and stability of the signal outputted from the cascaded signal output end. In addition, the cascaded signal output end is connected to a low-voltage signal input end via a transistor switch, so as to ensure that the cascaded signal output end keeps at a low voltage when no high voltage signal is outputted, and avoid signal variation appeared on the signal output end.

BRIEF DESCRIPTION OF THE SEVERAL VIEWS OF THE DRAWINGS

For explaining the technical solutions used in the existing arts or the embodiments more clearly, the appended figures to be used in describing the existing arts or the embodiments will be briefly introduced in the following. Obviously, the appended figures described below are only some of the embodiments of the invention, and those of ordinary skill in the art can further obtain other figures according to these figures without making any inventive effort.

DESCRIPTION OF SPECIFIC EMBODIMENTS OF THE INVENTION

The following descriptions for the respective embodiments are specific embodiments capable of being implemented for illustrations of the present invention with referring to the appended figures. In describing the present invention, spatially relative terms such as "upper", "lower", "front", "back", "left", "right", "inner", "outer", "lateral", and the like, may be used herein for ease of description as illustrated in the figures. Therefore, the spatially relative terms used herein are intended to illustrate the present invention for ease of understanding, but are not intended to limit the present invention. In the appended figures, units with similar structures are indicated by same reference numbers.

The embodiments of the present invention provide a display driving circuit. By arranging a capacitor and a cascaded signal output end on two branches that are connected in parallel to each other, a loss of a signal outputted from the cascaded signal output end, caused by the capacitor, is eliminated, and strength and stability of the signal outputted from the cascaded signal output end are improved. In addition, the cascaded signal output end is connected to a low-voltage signal input end via a transistor switch, so as to ensure that the cascaded signal output end keeps at a low voltage when no high voltage signal is outputted, and avoid signal variation appeared on the signal output end.

Figure 1:
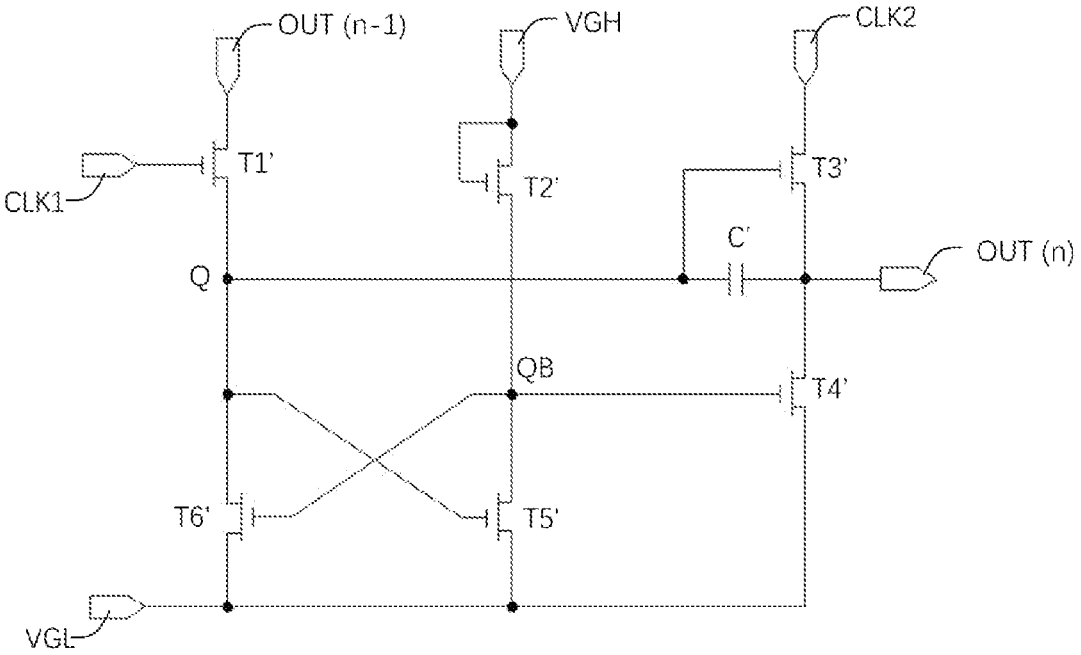
FIG. 1 (Prior Art)
FIG. 1 is a structural schematic diagram showing a driving unit of a display driving circuit in an existing art.
Figure 2:
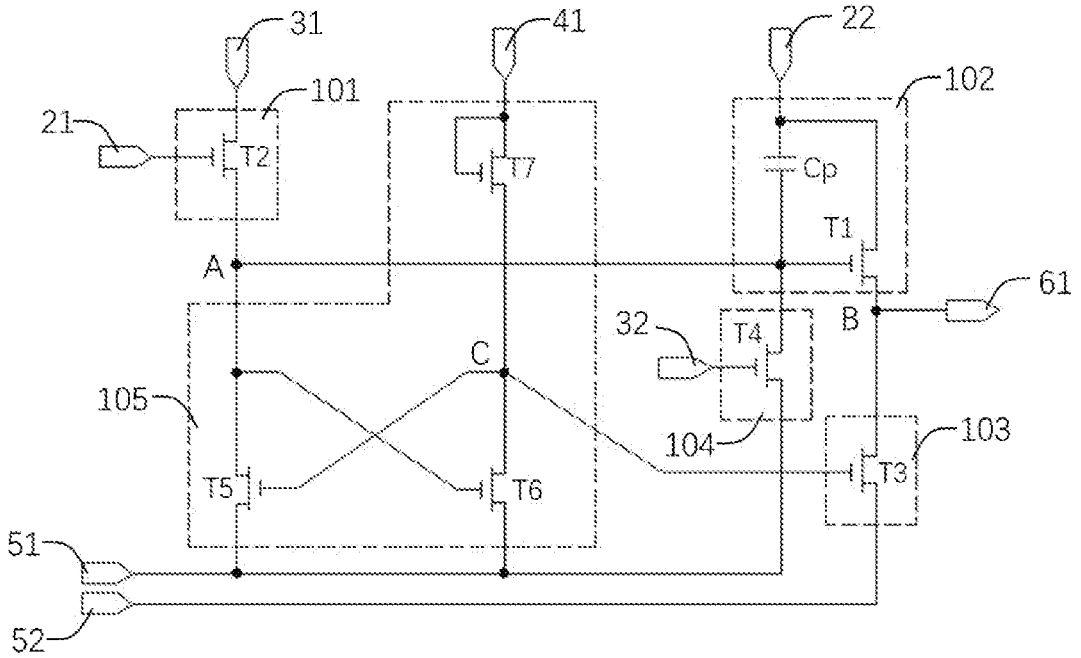
FIG. 2 is a structural schematic diagram showing a single-level driving unit in a display driving circuit provided in an embodiment of the present invention.

FIG. 2 is a structural schematic diagram showing a single-level driving unit in a display driving circuit provided in an embodiment of the present invention. It is noted that the display driving circuit includes a plurality of stages each of which is directed to the driving unit shown in FIG. 2, and there is a connection established between adjacent drive units.

The driving unit includes a pull-up control unit 101 and a pull-up unit 102.

The pull-up control unit 101 is electrically connected to a first clock signal input end 21, a first cascaded signal input end 31 and a first node A. The pull-up control unit 101 is configured to transmit a signal inputted from the first cascaded signal input end 31 to the first node A under the control of a signal inputted from the first clock signal input end 21.

Specifically, the pull-up control unit 101 includes a second transistor T2. A gate of the second transistor T2 is electrically connected to the first clock signal input end 21, a source of the second transistor T2 is electrically connected to the first cascaded signal input end 31 and a drain of the second transistor T2 is electrically connected to the first node A.

It is noted that the transistors used in the display driving circuit provided in the embodiments of the present invention can be n-type transistors, and can also be p-type transistors. Foe ease of understanding the present invention, n-type transistors are taken as an example in describing the following embodiments. It should be understood that for an n-type transistor, the source and the drain of the transistor are conducting and the transistor is switched on when the gate of the transistor is at a high level voltage, and otherwise, the transistor is switched off; for a p-type transistor, the source and the drain of the transistor are conducting and the transistor is switched on when the gate of the transistor is at a low level voltage, and otherwise, the transistor is switched off.

The pull-up unit 102 is electrically connected to the first node A, a second clock signal input end 22 and a second node B. The pull-up unit 102 is configured to transmit a signal inputted from the second clock signal input end 22 to the second node B under the control of a signal inputted from the first node A.

Specifically, the pull-up unit 102 includes a capacitor Cp and a first transistor T1. A first end of the capacitor Cp is electrically connected to the second clock signal input end 22 and a second end of the capacitor Cp is electrically connected to the first node A. The capacitor Cp is configured to couple the first node A to the second clock signal input end 22. The gate of the first transistor T1 is electrically connected to the first node A, the source of the first transistor T1 is electrically connected to the second clock signal input end 22 and the drain of the first transistor T1 is electrically connected to the second node B. The first transistor T1 is configured to transmit a signal inputted from the second clock signal input end 22 to the second node B under the control of a voltage signal of the first node A.

Specifically, the second node B is electrically connected to a cascaded signal output end 61. The cascaded signal output end 61 is configured to provide a scan signal to a display unit of a display panel.

It is noted that the two ends of the capacitor Cp are connected to the second clock signal input end 22 and the first node A, respectively, and the cascaded signal output end 61 is connected in parallel to the capacitor Cp via the first transistor T1, and accordingly, a signal transmitted by the second clock signal input end 22 to the cascaded signal output end 61 via the first transistor T1 will not be consumed by the capacitor Cp, thereby ensuring the signal outputted by the cascaded signal output end 61 to have sufficient strength and stability.

Based on an embodiment of the present invention, as shown in FIG. 2, the driving unit further includes a pull-down unit 103, a pull-down control unit 104 and a pull-down remaining unit 105.

The pull-down unit 103 is electrically connected to the second node B, a third node C and a second low-voltage signal input end 52. The pull-down unit 103 is configured to transmit a signal inputted from the second low-voltage signal input end 52 to the second node B under the control of a signal of the third node C, thereby pulling down the potential of the second node B such that the cascaded signal output end 61 outputs a low level voltage.

Specifically, the pull-down unit 103 includes a third transistor T3. The gate of the third transistor T3 is electrically connected to the third node C, the source of the third transistor T3 is electrically connected to the second low-voltage signal input end 52 and the drain of the third transistor T3 is electrically connected to the second node B.

The pull-down control unit 104 is electrically connected to the first node A, a second cascaded signal input end 32 and a first low-voltage signal input end 51. The pull-down control unit 104 is configured to transmit a signal inputted from the first low-voltage signal input end 51 to the first node A under the control of a signal inputted from the second cascaded signal input end 32, thereby pulling down the potential of the first node A.

Specifically, the pull-down control unit 104 includes a fourth transistor T4. The gate of the fourth transistor T4 is electrically connected to the second cascaded signal input end 32, the source of the fourth transistor T4 is electrically connected to the first low-voltage signal input end 51 and the drain of the fourth transistor T4 is electrically connected to the first node A.

The pull-down remaining unit 105 is electrically connected to the first node A, the third node C, a high-voltage signal input end 41 and the first low-voltage signal input end 51, and is configured to transmit a signal inputted from the first low-voltage signal input end 51 or a signal inputted from the high-voltage signal input 41 to the third node C under the control of a signal of the first node A, thereby pulling down or up the potential of the third node C.

Specifically, the pull-down remaining unit 105 includes a fifth transistor T5, a sixth transistor T6 and a seventh transistor T7. The sources of the fifth transistor T5 and the sixth transistor T6 are electrically connected to the first low-voltage signal input end 51. The drain of the fifth transistor T5 and the gate of the sixth transistor T6 are electrically connected to the first node A. The gate of the fifth transistor T5 and the drain of the sixth transistor T6 are electrically connected to the third node C. The gate and the source of the seventh transistor T7 is electrically connected to the high-voltage signal input 41. The drain of the seventh transistor T7 is electrically connected to the third node C.

It should be understood that the third node C is electrically connected to the first low-voltage signal input end 51 via the sixth transistor T6, and in this way, the third node C will be pulled down to a low-level voltage when the sixth transistor T6 is switched on. In addition, the third node C is electrically connected to the high-voltage signal input 41 via the seventh transistor T7 and the seventh transistor T7 is switched on all the way. In this way, when the sixth transistor T6 is switched off, the third node C will be pulled up to a high-level voltage.

It is noted that the display driving circuit provided in the embodiments of the present invention pulls down the potential of the first node A by the first low-voltage signal input end 51 and pulls down the potential of the second node B by the second low-voltage signal input end 52. This ensures that the cascaded signal output end 61 keeps at a low voltage when no high voltage signal is outputted, avoiding abnormal signal output from the cascaded signal output end 61 caused by potential variation of the second node B.

Optionally, the voltage inputted from the first low-voltage signal input end 51 is lower than the voltage inputted from the second low-voltage signal input end 52. It should be understood that the third node C is connected to the high-voltage signal input 41 and the first low-voltage signal input end 51 via the seventh transistor T7 and the sixth transistor T6, respectively, and when both of the seventh transistor T7 and the sixth transistor T6 are switched on, it needs to set the voltage inputted from the first low-voltage signal input end 51 to be sufficiently low, in order to pull down the third node C to be a sufficiently low voltage.

The structure of a single driving unit of the display driving circuit has been described in above embodiments. It should be understood that the display driving circuit provided in the present invention includes a plurality of stages each of which is directed to the driving unit. The cascading relation between the driving units of the display driving circuit will be described as follows.

Figure 3:
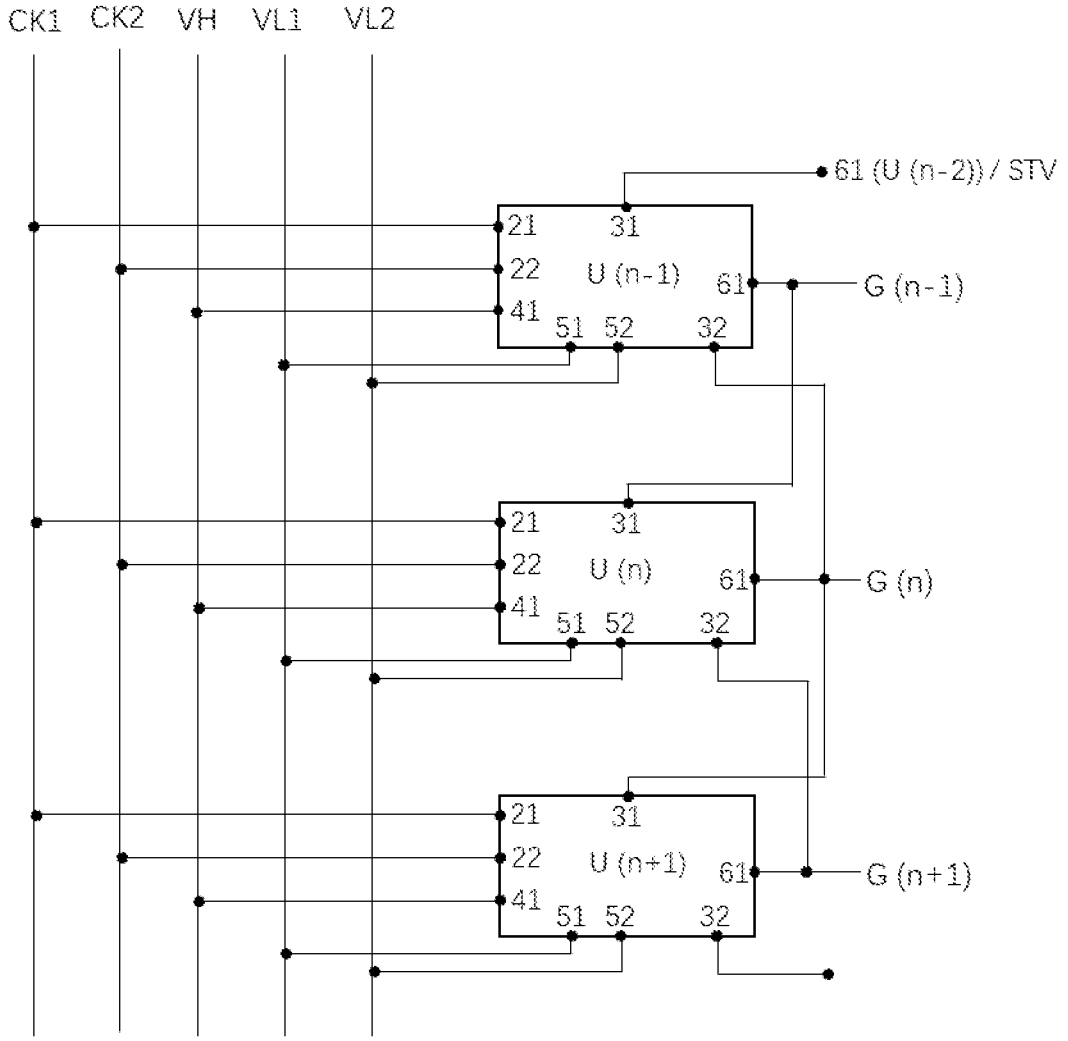
FIG. 3 is a diagram illustrating the cascading relation in a display driving circuit provided in an embodiment of the present invention.

FIG. 3 is a diagram illustrating the cascading relation in a display driving circuit provided in an embodiment of the present invention. The first cascaded signal input end 31 of the nth-stage driving unit U(n) is electrically connected to the cascaded signal output end 61 of the (n−1)th-stage driving unit U(n−1), and the second cascaded signal input end 32 of the nth-stage driving unit U(n) is electrically connected to the cascaded signal output end 61 of the (n+1)th-stage driving unit U(n+1), where n is an integer greater than or equal to 2.

Particularly, as shown in FIG. 3, when n=2, the first cascaded signal input end 31 of the 1st-stage driving unit is electrically connected to a start signal line STV.

As shown in FIG. 3, the following connection is for the driving unit of any stage. The first clock signal input end 21 is electrically connected to a first clock signal line CK1, which is configured to transmit a first clock signal to the first clock signal input end 21. The second clock signal input end 22 is electrically connected to a second clock signal line CK2, which is configured to transmit a second clock signal to the second clock signal input end 22. The first low-voltage signal input end 51 is electrically connected to a first low-voltage signal line VL1, which is configured to transmit a first low-voltage signal to the first low-voltage signal input end 51. The second low-voltage signal input end 52 is electrically connected to a second low-voltage signal line VL2, which is configured to transmit a second low-voltage signal to the second low-voltage signal input end 52. The high-voltage signal input 41 is electrically connected to a high-voltage signal line VH, which is configured to transmit a high-voltage signal to the high-voltage signal input 41.

It is noted that the cascaded signal output end 61 outputs a cascaded signal G, which is configured to drive a display unit of a display panel.

Figure 4:
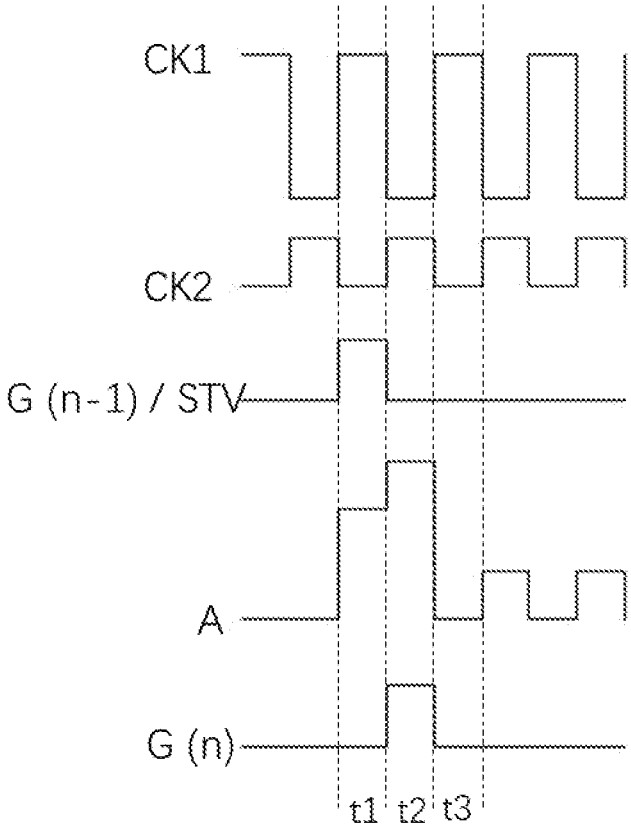
FIG. 4 is a diagram illustrating input/output timing of a display driving circuit provided in an embodiment of the present invention.

The input/output timing of the display driving circuit provided in the embodiments of the present invention will be analyzed below with reference to FIGS. 2 to 4. FIG. 4 is a diagram illustrating input/output timing of the display driving circuit provided in an embodiment of the present invention.

In a period of t1, the first clock signal line CK1 is at high voltage level, the second clock signal line CK2 is at low voltage level, and the (n−1)th-stage cascaded signal G(n−1) is at high voltage level. It is noted that when n=2, the (n−1)th-stage cascaded signal G(n−1) corresponds to a start signal STV. The second transistor T2 is switched on, and the first node A receives the (n−1)th-stage cascaded signal G(n−1) and manifests as high voltage level. The first transistor T1 and the sixth transistor T6 are switched on, and the third node C is pulled down to be low voltage level by the first low-voltage signal line VL1. The third transistor T3 is switched off, the second node B receives a signal from the second clock signal line CK2 and manifests as low voltage level, and the nth-stage cascaded signal G(n) manifests as a low voltage signal.

In a period of t2, the first clock signal line CK1 is at low voltage level, the second clock signal line CK2 is at high voltage level, and the (n−1)th-stage cascaded signal G(n−1) or the start signal STV is at low voltage level. The second transistor T2 is switched off, and under the coupling with the capacitor Cp, the potential of the first node A is pulled up in a further step and manifests as higher voltage level. The first transistor T1 is switched on, the third transistor T3 keeps switched off, the high voltage level of the second clock signal line CK2 is transmitted to the second node B, and the nth-stage signal G(n) manifests as a high voltage level signal.

In a period of t3, the first clock signal line CK1 is at high voltage level and the second clock signal line CK2 is at low voltage level. Meanwhile, as with the transmission of the cascaded signal G, the (n+1)th-stage cascaded signal G(n+1) is high voltage level. The fourth transistor T4 is switched on, and the first node A is pulled down to be low voltage level by the first low-voltage signal line VL1. The first transistor T1 and the sixth transistor T6 are switched off, and the third node C is pulled up to be high voltage level by the high-voltage signal line VH. The third transistor T3 is switched on, the second node B is pulled down to be low voltage level by the second clock signal line CK2, and the nth-stage cascaded signal G(n) manifests as a low voltage signal.

It is noted that in the period of t2, the signal from the second clock signal line CK2 is directly transmitted to the cascaded signal output end 61 via the first transistor T1, and the capacitor Cp will not cause a loss for the signal transmitted to the cascaded signal output end 61, thereby ensuring a stable cascaded signal outputted from the cascaded signal output end 61. In addition, In the period of t3 and a period of time after t3, the cascaded signal outputted by the cascaded signal output end 61 is maintained at low voltage level all the way by the second low-voltage signal line VL2, thereby avoiding abnormal variation of the cascaded signal outputted by the cascaded signal output end 61, caused by signal variation of the second clock signal line CK2.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A display driving circuit, comprising a plurality of stages each of which is directed to a driving unit that comprises:

a pull-up control unit, electrically connected to a first clock signal input end, a first cascaded signal input end and a first node, configured to transmit a signal inputted from the first cascaded signal input end to the first node under the control of a signal inputted from the first clock signal input end;

a pull-up unit, electrically connected to the first node, a second clock signal input end and a second node, configured to transmit a signal inputted from the second clock signal input end to the second node under the control of a signal of the first node; and the second node, electrically connected to a cascaded signal output end, wherein the pull-up unit comprises a capacitor and a first transistor, a first end of the capacitor is electrically connected to the second clock signal input end, a second end of the capacitor is electrically connected to the first node, and wherein a gate of the first transistor is electrically connected to the first node, a source of the first transistor is electrically connected to the second clock signal input end, a drain of the first transistor is electrically connected to the second node, wherein the driving unit comprises a first low-voltage signal input end and a second low-voltage signal input end, a voltage inputted to the first low-voltage signal input end is less than a voltage inputted to the second low-voltage signal input end, wherein the driving unit further comprises a pull-down unit, which is electrically connected to the second node, a third node, and the second low-voltage signal input end, and is configured to transmit a signal inputted from the second low-voltage signal input end to the second node under the control of a signal of the third node, wherein the driving unit further comprises a pull-down control unit, which is electrically connected to the first node, a second cascaded signal input end and the first low-voltage signal input end, and is configured to transmit a signal inputted from the first low-voltage signal input end to the first node under the control of a signal inputted from the second cascaded signal input end, wherein the driving unit further comprises a pull-down remaining unit, which is electrically connected to the first node, the third node, a high-voltage signal input and the first low-voltage signal input end, and is configured to transmit a signal inputted from the first low-voltage signal input end or a signal inputted from the high-voltage signal input to the third node under the control of a signal of the first node, wherein the first cascaded signal input end of the nth-stage driving unit is electrically connected to the cascaded signal output end of the (n−1)th-stage driving unit, and wherein the second cascaded signal input end of the nth-stage driving unit is electrically connected to the cascaded signal output end of the (n+1)th-stage driving unit, where n is an integer greater than or equal to 2.

2. The display driving circuit according to claim 1, wherein the pull-up control unit comprises a second transistor, the gate of the second transistor is electrically connected to the first clock signal input end, the source of the second transistor is electrically connected to the cascaded signal input end, the drain of the second transistor is electrically connected to the first node.

3. The display driving circuit according to claim 2, wherein the first transistor and the second transistor are n-type transistors or p-type transistors.

4. The display driving circuit according to claim 1, wherein the pull-down unit comprises a third transistor, the gate of the third transistor is electrically connected to the third node, the source of the third transistor is electrically connected to the second low-voltage signal input end, the drain of the third transistor is electrically connected to the second node.

5. The display driving circuit according to claim 4, wherein the third transistor is an n-type transistor or a p-type transistor.

6. The display driving circuit according to claim 1, wherein the pull-down control unit comprises a fourth transistor, the gate of the fourth transistor is electrically connected to the second cascaded signal input end, the source of the fourth transistor is electrically connected to the first low-voltage signal input end, the drain of the fourth transistor is electrically connected to the first node.

7. The display driving circuit according to claim 6, wherein the fourth transistor is an n-type transistor or a p-type transistor.

8. The display driving circuit according to claim 1, wherein the pull-down remaining unit comprises a fifth transistor, a sixth transistor and a seventh transistor, the sources of the fifth transistor and the sixth transistor are electrically connected to the first low-voltage signal input end, the drain of the fifth transistor and the gate of the sixth transistor are electrically connected to the first node, the gate of the fifth transistor and the drain of the sixth transistor are electrically connected to the third node, the gate and the source of the seventh transistor are electrically connected to the high-voltage signal input, the drain of the seventh transistor is electrically connected to the third node.

9. The display driving circuit according to claim 8, wherein the fifth transistor, the sixth transistor and the seventh transistor are n-type transistors or p-type transistors.

10. The display driving circuit according to claim 1, wherein the first cascaded signal input end of the 1st-stage driving unit is electrically connected to a start signal line.

11. The display driving circuit according to claim 1, wherein the first clock signal input end is electrically connected to a first clock signal line, the second clock signal input end is electrically connected to a second clock signal line, the first low-voltage signal input end is electrically connected to a first low-voltage signal line, the second low-voltage signal input end is electrically connected to a second low-voltage signal line, the high-voltage signal input is electrically connected to a high-voltage signal line.

12. The display driving circuit according to claim 11, wherein a clock signal transmitted on the first clock signal line is opposite to a clock signal transmitted on the second clock signal line.

* * * * *